US008510904B2

(12) United States Patent
Eckstein

(10) Patent No.: US 8,510,904 B2
(45) Date of Patent: Aug. 20, 2013

(54) SUCTION CLEANING APPARATUS

(75) Inventor: Daniel Eckstein, Winnenden (DE)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 13/274,583

(22) Filed: Oct. 17, 2011

(65) Prior Publication Data

US 2012/0090130 A1 Apr. 19, 2012

Related U.S. Application Data

(63) Continuation of application No. PCT/EP2010/053901, filed on Mar. 25, 2010.

(30) Foreign Application Priority Data

Apr. 30, 2009 (DE) ..... 10 2009 020 769

(51) Int. Cl.
*A47L 9/20* (2006.01)

(52) U.S. Cl.
USPC ..... 15/327.2; 15/347; 15/352

(58) Field of Classification Search
USPC ..... 15/327.2, 347, 352
IPC ..... A47L 5/36, 9/20
See application file for complete search history.

(56) References Cited

U.S. PATENT DOCUMENTS

| | | | |
|---|---|---|---|
| 2,591,567 | A | 4/1952 | Lofgren et al. |
| 3,325,979 | A | 6/1967 | Smith |
| 3,363,764 | A | 1/1968 | Whitaker |
| 3,396,516 | A | 8/1968 | Ballard |
| 3,431,709 | A | 3/1969 | Kawanami |
| 3,498,030 | A | 3/1970 | Wilki |
| 3,509,394 | A | 4/1970 | Heidtmann |
| 3,536,094 | A | 10/1970 | Manley, Jr. |
| 3,731,465 | A | 5/1973 | Ohira et al. |
| 3,748,836 | A | 7/1973 | Bachle |
| 3,792,569 | A | 2/1974 | Carlson et al. |

(Continued)

FOREIGN PATENT DOCUMENTS

| | | |
|---|---|---|
| DE | 210 658 | 6/1909 |
| DE | 276953 | 7/1914 |

(Continued)

OTHER PUBLICATIONS

U.S. Appl. No. 13/269,652, filed Oct. 10, 2011, Rentschler et al.

(Continued)

*Primary Examiner* — David Redding
(74) *Attorney, Agent, or Firm* — Lipsitz & McAllister, LLC

(57) ABSTRACT

A suction cleaning apparatus comprising a dirt collection container which has a suction inlet and is fluidly connected to at least one suction unit via at least one filter and at least one suction channel is provided. The suction cleaning apparatus further has at least one external air inlet which opens out into the suction channel downstream of the at least one filter and which is selectively closable and openable by means of a closing body. In order to reduce the installation space of the closing body required for proper filter cleaning, the suction channel has an external air inlet wall with at least one external air inlet. The closing body, sliding along the outer side of the external air inlet wall, is reciprocatingly movable between a closed position closing the at least one external air inlet and an open position opening the at least one external air inlet.

17 Claims, 4 Drawing Sheets

(56) References Cited

U.S. PATENT DOCUMENTS

| | | | |
|---|---|---|---|
| 3,868,237 | A | 2/1975 | Berz |
| 3,945,390 | A | 3/1976 | Huber |
| 3,951,623 | A | 4/1976 | Furstenberg |
| 3,994,067 | A | 11/1976 | Hazzard et al. |
| 4,033,732 | A | 7/1977 | Axelsson et al. |
| 4,124,915 | A | 11/1978 | Schlicher |
| 4,124,916 | A | 11/1978 | Fromknecht |
| 4,171,208 | A | 10/1979 | Lowder |
| 4,277,265 | A | 7/1981 | Leinfelt |
| 4,329,161 | A | 5/1982 | Osborn |
| RE31,417 | E | 10/1983 | Huber |
| 4,482,129 | A | 11/1984 | Baker et al. |
| 4,581,135 | A | 4/1986 | Gerulis |
| 4,719,662 | A | 1/1988 | Horak et al. |
| 4,733,326 | A | 3/1988 | Harsch et al. |
| 4,921,510 | A | 5/1990 | Plooy |
| 5,002,594 | A | 3/1991 | Merritt |
| 5,178,652 | A | 1/1993 | Hüttlin |
| 5,217,509 | A | 6/1993 | Jansen |
| 5,246,205 | A | 9/1993 | Gillingham et al. |
| 5,322,534 | A | 6/1994 | Kaiser |
| 5,368,060 | A | 11/1994 | Worrall et al. |
| 5,369,839 | A | 12/1994 | Wörwag |
| 5,511,583 | A | 4/1996 | Bassett |
| 5,882,180 | A | 3/1999 | Kawaguchi et al. |
| 5,951,746 | A | 9/1999 | Treitz et al. |
| 5,975,062 | A | 11/1999 | Bonse et al. |
| 6,406,505 | B1 | 6/2002 | Oh et al. |
| 6,440,191 | B1 | 8/2002 | Berfield et al. |
| 6,458,178 | B1 | 10/2002 | Dietz et al. |
| 6,517,325 | B2 | 2/2003 | Tsuru et al. |
| 6,640,385 | B2 | 11/2003 | Oh et al. |
| 6,782,583 | B2 | 8/2004 | Oh |
| 6,936,161 | B2 | 8/2005 | Wright et al. |
| 7,082,640 | B2 | 8/2006 | McCutchen |
| 7,340,797 | B2 | 3/2008 | Theiss, Jr. et al. |
| 7,647,672 | B2 | 1/2010 | Nam et al. |
| 7,861,367 | B2 | 1/2011 | Eckstein et al. |
| 7,947,099 | B2 | 5/2011 | Valentini |
| 7,976,614 | B2 | 7/2011 | Eckstein et al. |
| 8,015,660 | B2 | 9/2011 | Bruntner |
| 2002/0066262 | A1 | 6/2002 | Oh |
| 2002/0088078 | A1 | 7/2002 | Oh et al. |
| 2002/0124729 | A1 | 9/2002 | Dudley |
| 2003/0041729 | A1 | 3/2003 | Finigan |
| 2003/0167590 | A1 | 9/2003 | Oh |
| 2005/0011036 | A1 | 1/2005 | McCutchen |
| 2005/0251953 | A1 | 11/2005 | Hackwell et al. |
| 2005/0254270 | A1 | 11/2005 | Melchert et al. |
| 2008/0086835 | A1 | 4/2008 | Stewen et al. |
| 2008/0092498 | A1 | 4/2008 | Stewen et al. |
| 2009/0000485 | A1 | 1/2009 | Valentini |
| 2009/0027823 | A1 | 1/2009 | Follic et al. |
| 2009/0106933 | A1 | 4/2009 | Bruntner |
| 2009/0205158 | A1 | 8/2009 | Eckstein et al. |
| 2009/0205159 | A1 | 8/2009 | Stewen et al. |
| 2009/0205491 | A1 | 8/2009 | Eckstein et al. |
| 2009/0205499 | A1 | 8/2009 | Eckstein et al. |

FOREIGN PATENT DOCUMENTS

| | | |
|---|---|---|
| DE | 338942 | 7/1921 |
| DE | 1 844 732 | 1/1962 |
| DE | 1 245 550 | 7/1967 |
| DE | 1 407 945 | 11/1968 |
| DE | 1 800 480 | 6/1970 |
| DE | 2 102 231 | 7/1971 |
| DE | 2 106 058 | 9/1971 |
| DE | 2 416 071 | 10/1974 |
| DE | 91 04 127 | 7/1991 |
| DE | 41 38 223 | 2/1993 |
| DE | 197 01 983 | 6/1998 |
| DE | 298 23 411 | 7/1999 |
| DE | 199 49 095 | 4/2001 |
| DE | 200 10 608 | 12/2001 |
| DE | 100 56 935 | 2/2002 |
| DE | 101 40 351 | 6/2002 |
| DE | 101 01 219 | 7/2002 |
| DE | 101 50 257 | 7/2002 |
| DE | 102 40 618 | 9/2003 |
| DE | 695 30 326 | 5/2004 |
| DE | 20 2004 012 911 | 11/2004 |
| DE | 10 2005 029 606 | 1/2006 |
| DE | 10 2004 056 076 | 5/2006 |
| DE | 10 2005 017 568 | 10/2006 |
| DE | 10 2005 017 702 | 10/2006 |
| DE | 10 2005 035 884 | 2/2007 |
| DE | 20 2007 015 242 | 1/2008 |
| EP | 0 289 987 | 11/1988 |
| EP | 0 197 036 | 3/1990 |
| EP | 0 955 003 | 11/1999 |
| EP | 0 873 075 | 2/2000 |
| EP | 1 166 705 | 1/2002 |
| EP | 1 340 446 | 9/2003 |
| EP | 1 656 872 | 5/2006 |
| EP | 1 743 562 | 1/2007 |
| EP | 1 913 857 | 4/2008 |
| EP | 1 997 415 | 12/2008 |
| GB | 956764 | 4/1964 |
| GB | 2 337 922 | 12/1999 |
| JP | 08038401 | 2/1996 |
| JP | 2002028107 | 1/2002 |
| JP | 2006181228 | 7/2006 |
| SU | 644513 | 1/1979 |
| WO | 85/02528 | 6/1985 |
| WO | 95/10972 | 4/1995 |
| WO | 95/27431 | 10/1995 |
| WO | 97/19630 | 6/1997 |
| WO | 01/74493 | 10/2001 |
| WO | 2004/100752 | 11/2004 |
| WO | 2005/006934 | 1/2005 |
| WO | 2006/108459 | 10/2006 |
| WO | 2008/014794 | 2/2008 |
| WO | 2008/014795 | 2/2008 |
| WO | 2008/014796 | 2/2008 |
| WO | 2008/014797 | 2/2008 |
| WO | 2008/014798 | 2/2008 |

OTHER PUBLICATIONS

U.S. Appl. No. 13/310,993, filed Dec. 5, 2011, Treitz.

SUCTION CLEANING APPARATUS

This application is a continuation of international application number PCT/EP2010/053901 filed on Mar. 25, 2010 and claims the benefit of German application number 10 2009 020 769.4 filed on Apr. 30, 2009.

The present disclosure relates to the subject matter disclosed in international application number PCT/EP2010/053901 filed on Mar. 25, 2010 and German application number 10 2009 020 769.4 filed on Apr. 30, 2009, which are incorporated herein by reference in their entirety and for all purposes.

BACKGROUND OF THE INVENTION

The invention relates to a suction cleaning apparatus comprising a dirt collection container which has a suction inlet and is fluidly connected to at least one suction unit via at least one filter and at least one suction channel, and comprising at least one external air inlet which opens out into the suction channel downstream of the at least one filter and is selectively closable and openable by means of a closing body.

With such a suction cleaning apparatus, dirt and in an advantageous embodiment also liquid can be sucked up by applying negative pressure to the dirt collection container by means of the at least one suction unit, so that a suction flow is formed. The suction cleaning apparatus has at least one filter that is arranged in the flow path between the dirt collection container and the suction unit and serves to separate solid matter from the suction flow. During suction operation, dirt particles are increasingly deposited on the dirty side of the at least one filter facing towards the dirt collection container, so that the filter needs to be cleaned after a certain length of time. For the purpose of cleaning, external air can be applied to the clean side of the filter facing away from the dirt collection container by a closing body opening at least one external air inlet which opens out into the suction channel downstream of the filter.

Suction apparatuses of this type are, for example, known from DE 298 23 411 U1 and DE 10 2005 017 702 A1. Here the closing bodies are designed as a valve disk of a lift valve which can be held, by means of an electromagnet, in a closed position in which it closes the at least one external air inlet. When the supply of energy to the electromagnet is interrupted, the valve disk lifts off the external air inlet, so that external air can abruptly flow into the suction channel and impinge on the clean side of the filter. Suction cleaning apparatuses of this type have proved successful. However, in order for the filter cleaning process to function properly, the closing body designed as a valve disk of a lift valve requires considerable installation space.

It is an object of the present invention to improve a suction cleaning apparatus of the type indicated at the outset in such a manner that the installation space of the closing body required for proper filter cleaning can be reduced.

SUMMARY OF THE INVENTION

This object is achieved, in accordance with the invention, in a suction cleaning apparatus of the generic type in that the suction channel has an external air inlet wall with at least one external air inlet and in that the closing body, sliding along the outer side of the external air inlet wall, is reciprocatingly movable between a closed position closing the at least one external air inlet and an open position opening the at least one external air inlet.

The invention incorporates the idea of enabling the closing body's installation space required for proper filter cleaning to be considerably reduced by the closing body sliding along the outer side of the external air inlet wall which has the at least one external air inlet. Thus, to open the at least one external air inlet, it is not required for the closing body to lift off the external air inlet wall; instead, it can be moved along the outer side of the external air inlet wall with which it is in sliding contact.

Preferably, the external air inlet wall comprises a plurality of external air inlets which are simultaneously opened by the closing body passing from its closed position to its open position.

It is particularly advantageous for the external air inlets to be of slot-shaped configuration and for the closing body to be movable from its closed position to its open position in a direction transverse to the longitudinal axis of the slot-shaped external air inlets. Such a configuration has the advantage that it takes only a relatively small lift movement of the closing body in order to enable all of the slot-shaped external air inlets to be simultaneously and fully opened.

Advantageously, the external air inlet wall and the closing body are of plate-shaped configuration. This results in a further reduction of the installation space required.

The plate-shaped configuration of the external air inlet wall and the closing body allows the closing body to be linearly displaceable along the outer side of the external air inlet wall. However, it may also be provided for the closing body to be pivotable. This is advantageous in particular where the external air inlets are arranged in a spoke-shaped manner, i.e. where the external air inlets are directed radially outward relative to a centre point. The centre point may define the pivot axis of the pivotable closing body which in its closed position closes, and in its open position opens the radially extending external air inlets.

It may further be provided for the external air inlet wall and the closing body to be cylindrically curved. It is advantageous for the closing body to be pivotable about the cylinder axis of the external air inlet wall.

In an advantageous embodiment which is distinguished by a very low cost of manufacture and very low susceptibility to malfunctioning, the closing body contacts the external air inlet wall directly. With such a configuration, the need for sealing elements, for example O-rings, between the closing body and the external air inlet wall can be eliminated.

It is advantageous for the closing body, under the action of the pressure difference between the negative pressure existing in the suction channel during operation of the suction cleaning apparatus and the external pressure acting on the exterior of the closing body, to be elastically deformable to a greater extent than the external air inlet wall. The higher level of elastic deformability of the closing body causes the closing body, during operation of the suction cleaning apparatus, to be pressed against the external air inlet wall, which has a lower level of elastic deformability. Pressing the closing body against the external air inlet wall results in the external air inlets being reliably sealed during suction operation of the suction cleaning apparatus.

It may, for example, be provided for the closing body and the external air inlet wall to be made of different materials, with the material of the closing body having a greater elastic deformability than the material of the external air inlet wall.

Alternatively, provision may be made for the closing body and the external air inlet wall to be made of the same material but with the external air inlet wall having a greater dimensional stability than the closing body. For example, the external air inlet wall may have a greater material thickness than the closing body.

In a particularly preferred embodiment of the invention, the external air inlet wall has reinforcement elements on its inner side. The reinforcement elements ensure that the external air inlet wall has only a very low level of elastic deformability; it is thus of more rigid construction than the closing body and forms for the closing body an abutment which bends only slightly during suction operation of the suction cleaning apparatus. The reinforcement elements are preferably configured as reinforcement ribs integrally formed on the external air inlet wall.

It may be provided for at least one reinforcement rib to be arranged in each case between adjacent external air inlets.

In an advantageous embodiment, particularly effective filter cleaning is achieved by the external air inlet wall lying opposite the clean side of the filter. With such a configuration, the external air inlet wall forms a cover of the filter, so that the external air flowing through the external air inlets in the open position of the closing body reaches the clean side of the filter directly and shakes the latter mechanically, with at least a portion of the inflowing external air being allowed to flow through the filter in a direction reverse to the direction of flow prevailing during suction operation of the suction cleaning apparatus. This is a particularly effective way to clean the filter.

It may be provided for the filter to be configured as a cartridge filter; in particular, the filter may be of cylinder-shaped configuration.

In an advantageous embodiment, however, the filter is configured as a flat pleated filter because this enables the installation space to be kept small.

It is advantageous for the external air inlet wall to cover the flat pleated filter. The external air inlet wall may extend over the entire length and over the entire width of the flat pleated filter, so that external air can be applied to the latter along the entire outer side thereof.

It may be provided for the closing body to be reciprocatingly movable by motor between its closed position and its open position. To this end, an electric drive or a pneumatic drive may be employed.

It may also be provided for the closing body to be electromagnetically movable. To this end, a lift magnet may be employed. For example, a lift magnet may be provided that urges the closing body to its open position against the action of a spring force. The lift magnet may be energized for a short time once or several times in succession through the use of control electronics in order to clean the filter automatically.

In a preferred embodiment, the closing body is manually movable. Such a configuration is distinguished by a particularly low cost of manufacture. In addition, the installation space for the closing body and its drive can be kept particularly small.

Advantageously, the closing body is movable by means of a pivot lever. The pivot lever may be operated by the user of the suction cleaning apparatus in order to clean the filter.

In an advantageous embodiment, the closing body is movable against the action of a return spring from its closed position to its open position. The return spring ensures that the closing body, starting from its open position, can be reliably returned to its closed position.

The return spring may, for example, be configured as a compression spring.

In particular, it may be provided for the return spring to be of helical configuration.

In an advantageous embodiment, the return spring is arranged on the outer side of the external air inlet wall. To this end, the external air inlet wall may have a recess which is contacted by the return spring. This allows the installation space to be reduced further.

The following description of a preferred embodiment of the invention, taken in conjunction with the drawings, serves to explain the invention in greater detail.

DETAILED DESCRIPTION OF THE INVENTION

Figure 1:
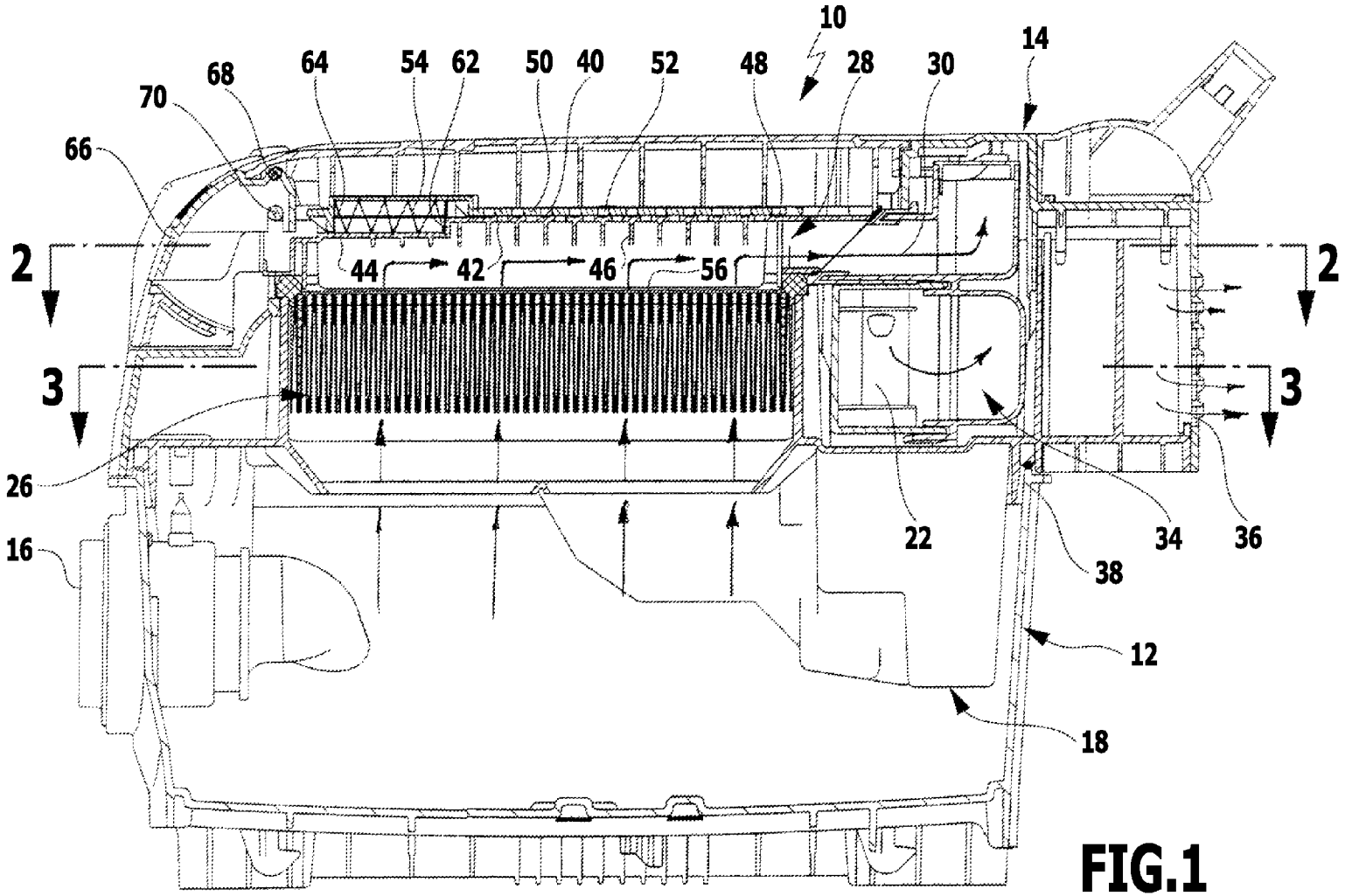
FIG. 1 is a vertical sectional view of a suction cleaning apparatus during suction operation.

The drawings schematically illustrate a suction cleaning apparatus 10 in accordance with the invention, said apparatus having a lower part forming a dirt collection container 12, and an upper part 14 that can be mounted on the lower part. The dirt collection container 12 has a suction inlet 16 to which may be connected, in the usual manner, a suction hose (not shown in the drawings), the free end of which may hold a suction nozzle. Alternatively, it may be provided for the suction hose to be connected to a machining tool such as a drilling machine or a milling unit, so that dust generated during operation of the machining tool can be sucked off.

The upper part 14 accommodates a suction unit 18 with an electric motor 20 and a suction turbine 22. The suction unit 18 is horizontally arranged, i.e. the turbine axis 24 of the suction unit 18 extends in a horizontal direction.

Figure 2:
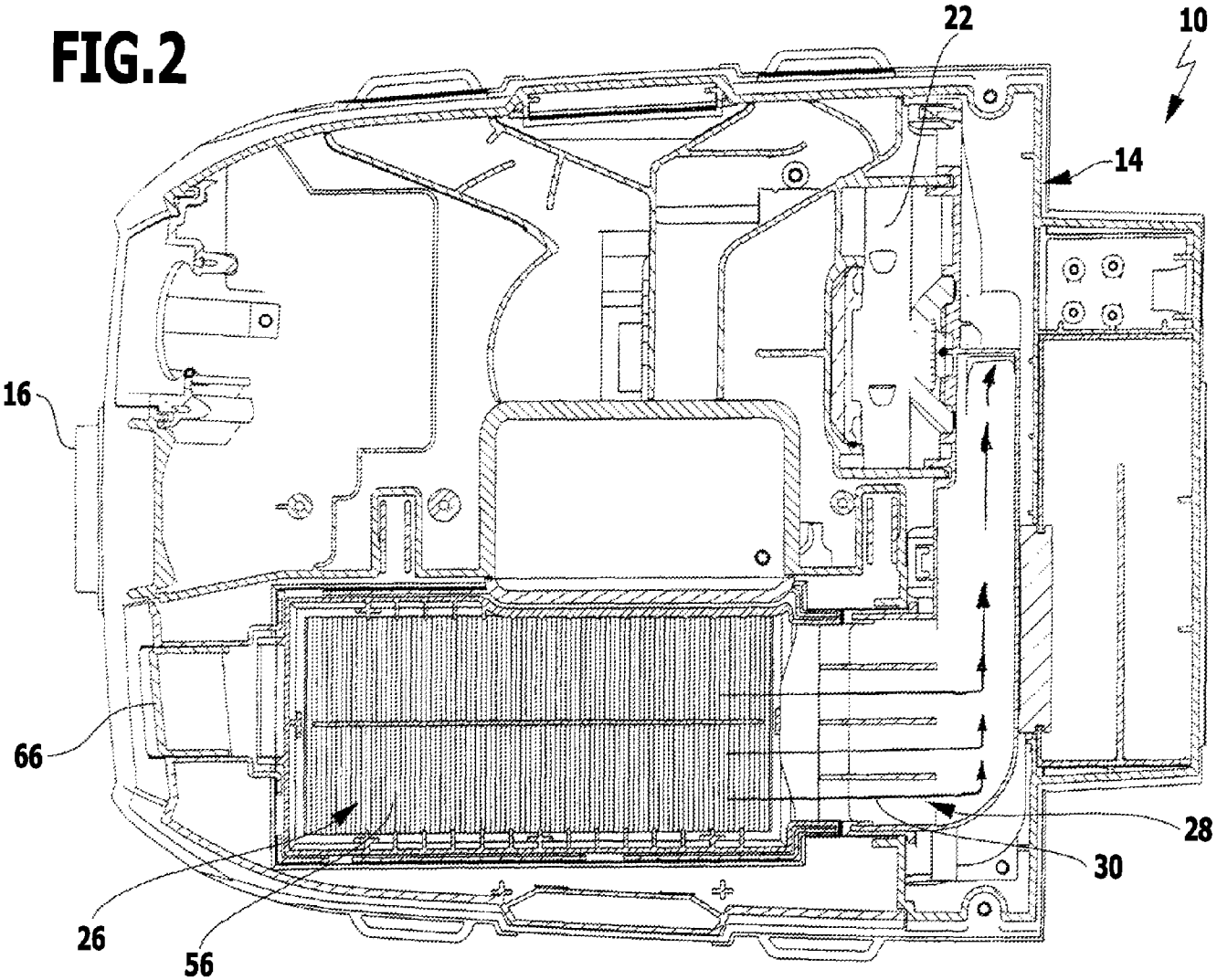
FIG. 2 is a sectional view of the suction cleaning apparatus taken along line 2-2 in FIG. 1.
Figure 3:
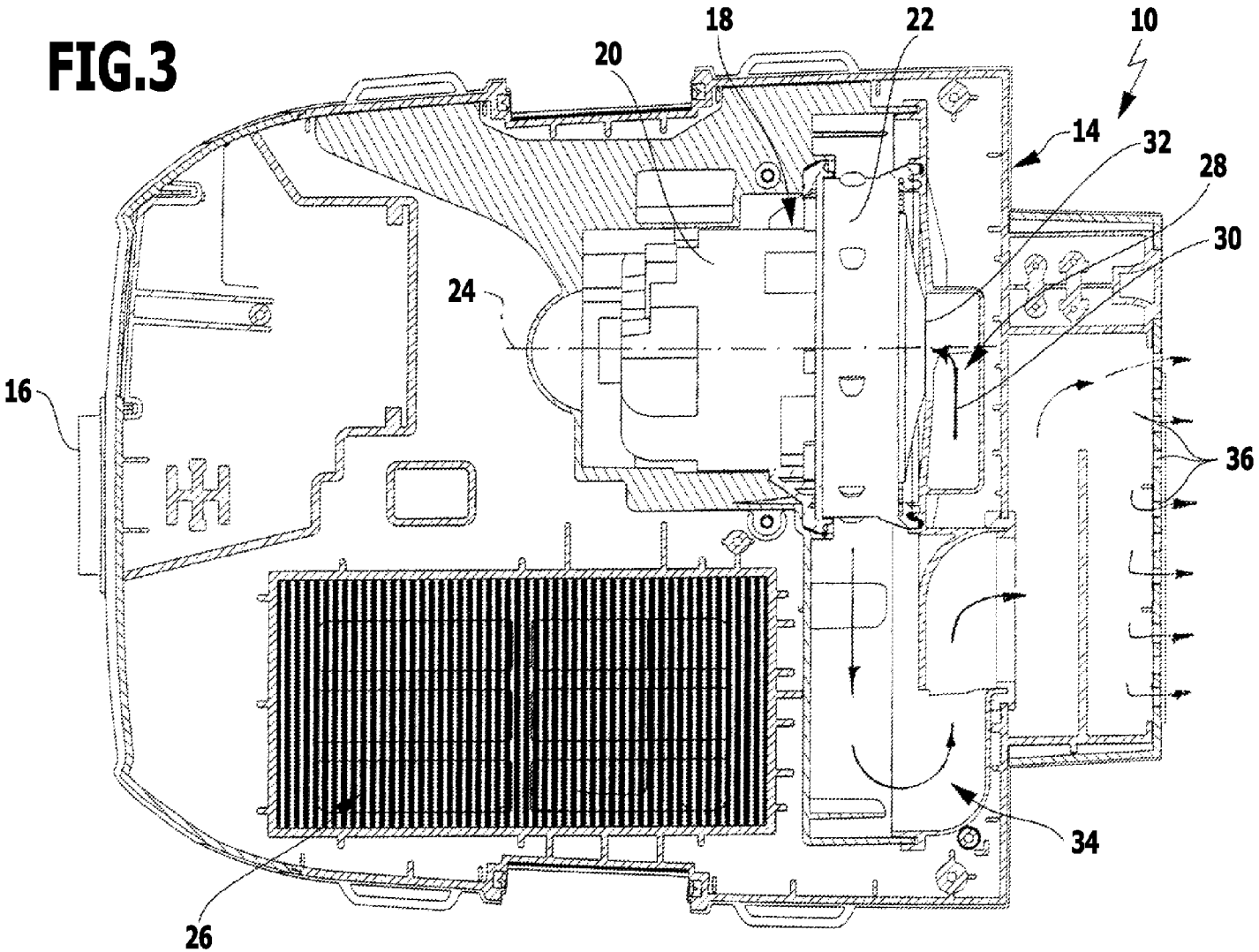
FIG. 3 is a sectional view of the suction cleaning apparatus taken along line 3-3 of FIG. 1.

Held laterally beside the suction unit 18, within the upper part 14, is a flat pleated filter 26 which is followed, within the upper part 14, by a suction channel 28. The suction channel 28 fluidly interconnects the dirt collection container 12 and the suction unit 18. Negative pressure can be applied to the dirt collection container 12 via the suction channel 28 and the flat pleated filter 26, so that the suction flow symbolized by the arrows 30 in FIG. 1 is formed and dirt can be sucked into the dirt collection container 12 under the action of said suction flow. The dirt particles can be separated from the suction flow 30 by means of the flat pleated filter 26. In this process, the suction unit 18 draws in suction air which, starting from the dirt collection container 12, flows through the flat pleated filter 26 and reaches the suction inlet 32 of the suction unit 18 by way of the suction channel 28. The suction air is drawn in axially relative to the turbine axis 24 and is expelled from the suction turbine 22 in a radial direction. The exhaust air then flows through an exhaust air channel 34 adjoining the suction turbine 22, said exhaust air channel forming a flow labyrinth and discharging the exhaust air through exhaust air openings 36 to the surroundings. As shown in particular in FIGS. 1, 2 and 3, the exhaust air channel 34 is arranged below the suction channel 28 in the rear area 38 of the suction cleaning apparatus 10 facing away from the suction inlet 16.

Above the flat pleated filter 26, the suction channel 28 has a channel wall in the form of an external air inlet wall 40 which extends over the entire length and over the entire width of the flat pleated filter 26 and has a plurality of slot-shaped external air inlets 42 arranged side by side and spaced at a uniform distance from each other. Between external air inlets 42 that are immediately adjacent to each other, a reinforcement rib 46 is in each case integrally formed on the interior side 44 of the external air inlet wall 40.

Figure 4:
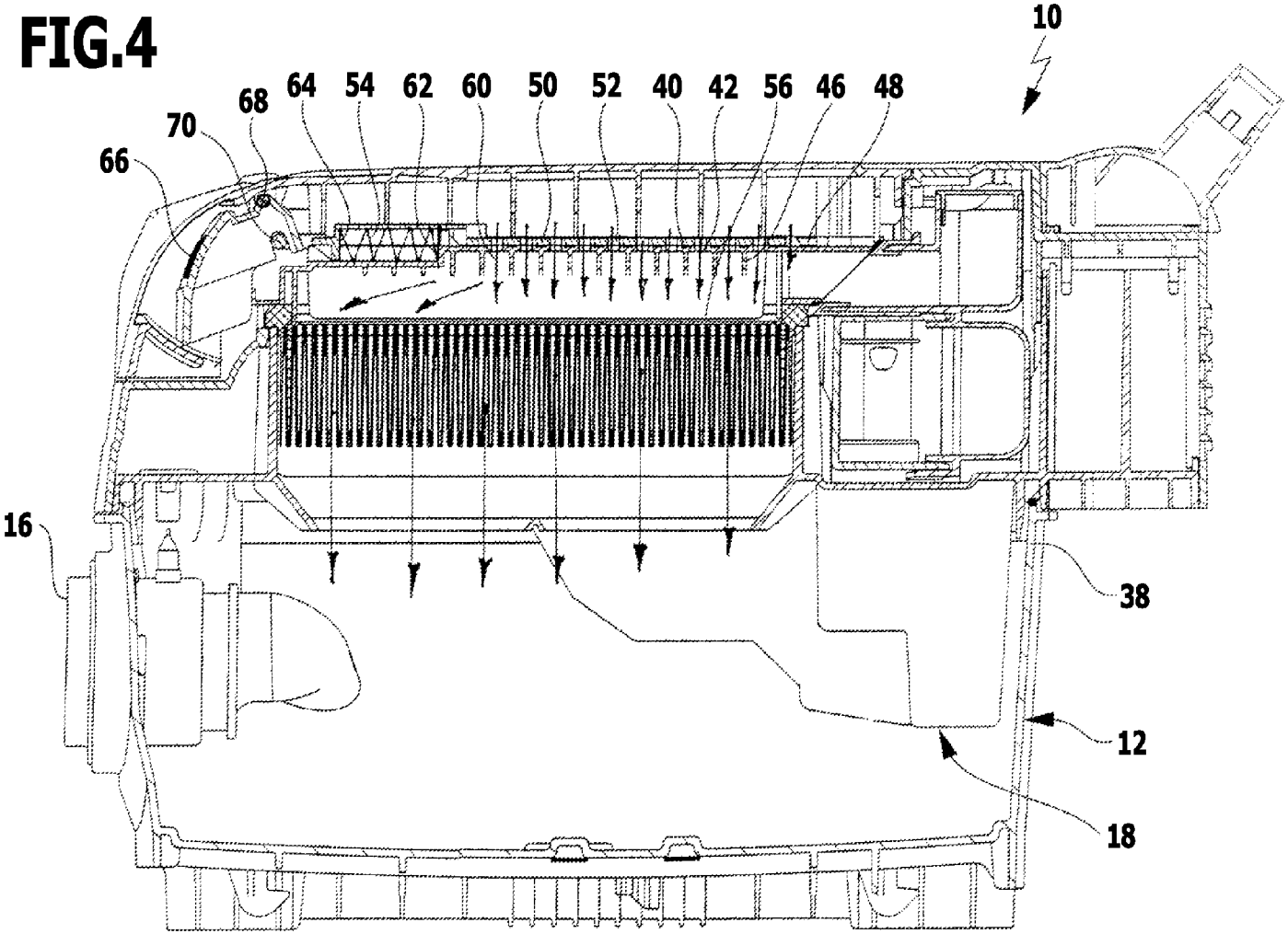
FIG. 4 is a vertical sectional view of the suction cleaning apparatus of FIG. 1 shown in the process of cleaning a filter.

A plate-shaped closing body 50 is in sliding contact with the outer side 48 of the plate-shaped external air inlet wall 40. The closing body 50 has a plurality of slot-shaped passages 52 having a configuration identical to that of the external air inlets 42 of the external air inlet wall 40. However, the passages 52 in the closed position of the closing body 50 as shown in FIG. 1 are arranged in a laterally offset relation to the external air inlets 42, so that the closing body 50 closes the external air inlets 42. Starting from the closed position depicted in FIG. 1, the closing body 50 can be displaced against the action of a return spring 54 to the open position shown in FIG. 4. In the open position, the passages 52 are in line with the external air inlets 42. As a result, external air can flow via the passages 52 and the external air inlets 42 into the area of the suction channel 28 adjoining the flat pleated filter 26. The external air impinges on the clean side 56 of the flat pleated filter 26 facing away from the dirt collection container 12, and a portion of the external air flows through the flat pleated filter 26 in a direction counter to the direction of flow forming during normal suction operation. The flat pleated filter 26 is thereby cleaned in an effective manner. The external air flow forming in the open position of the closing body 50 is indicated in FIG. 4 by the arrows 60.

The return spring 54 is arranged between the external air inlet wall 40 and the closing body 50 on the outer side 48 of the external air inlet wall 40. It is supported, on the one hand, on a step 62 of the external air inlet wall 40 and, on the other hand, on a step 64 of the closing body 50.

A pivot lever 66 is used for displacing the closing body 50 along the outer side 48 of the external air inlet wall 40, said pivot lever being mounted on the upper part 14 for pivotal movement about a pivot axis 68 and operable by the user of the suction cleaning apparatus 10. The pivot lever 66 is in engagement with an actuating pin 70 connected in one piece to the closing body 50, said actuating pin being arranged below the pivot lever 66 when the closing body 50 is in the closed position as shown in FIG. 1. When operated by the user, the pivot lever 66, via the actuating pin 70, displaces the closing body 50 along the outer side 48 to the open position shown in FIG. 4. When the user then releases the pivot lever 66, the return spring 54 again displaces the closing body 50 along the outer side 48 to its closed position.

Owing to the reinforcement ribs 46, the external air inlet wall 40 has a considerably higher dimensional stability than the closing body 50. The latter is elastically deformable to a greater extent than the external air inlet wall 40. As a result, during suction operation of the suction cleaning apparatus 10 the closing body is pressed against the outer side 48 of the external air inlet wall 40 on account of the action of the pressure difference between the negative pressure existing in the suction channel 28 during operation of the suction cleaning apparatus 10 and the external pressure acting upon the exterior of the closing body 50. The external air inlets 42 can therefore be tightly closed by the closing body 50 without the need to use an additional sealing means such as a sealing ring.

In making the transition from its closed position to its open position, the closing body 50 lying flat against the outer side 48 of the external air inlet wall 40 undergoes only a very short lift movement which corresponds to half of the distance between two adjacent external air inlets 42. As a result of the short lift movement, the external air inlets 42 can be fully opened within a very short time, so that external air can abruptly impinge on the clean side 56 of the flat pleated filter 26 in order to clean the same effectively. With a negative pressure existing within the dirt collection container 12 during the transition of the closing body 50 from its closed position to its open position, a considerable portion of the abruptly entering external air is drawn through the flat pleated filter 26 into the dirt collection container 12. This enhances the mechanical cleaning of the flat pleated filter 26.

After briefly operating the pivot lever 66, the user can release the pivot lever 66, as mentioned before, with the closing body 50 then being automatically displaced to its closed position under the action of the return spring 54, so that suction operation of the suction cleaning apparatus 10 can be resumed.

The invention claimed is:

1. Suction cleaning apparatus, comprising:

a dirt collection container which has a suction inlet and is fluidly connected to at least one suction unit via at least one filter and at least one suction channel, at least one external air inlet which opens out into the at least one suction channel downstream of the at least one filter and is selectively closable and openable by means of a closing body, the at least one suction channel having an external air inlet wall with at least one external air inlet, and the closing body, sliding along an outer side of the external air inlet wall, is reciprocatingly movable between a closed position closing the at least one external air inlet and an open position opening the at least one external air inlet, wherein the closing body is movable against an action of a return spring from the closed position to the open position.

2. Suction cleaning apparatus in accordance with claim 1, wherein the external air inlet wall and the closing body are of plate-shaped configuration.

3. Suction cleaning apparatus in accordance with claim 1, wherein the closing body contacts the external air inlet wall directly.

4. Suction cleaning apparatus in accordance with claim 1, wherein the closing body, under action of a pressure difference between a negative pressure existing in the at least one suction channel during operation of the suction cleaning apparatus and an external pressure acting on an exterior of the closing body, is elastically deformable to a greater extent than the external air inlet wall.

5. Suction cleaning apparatus in accordance with claim 1, wherein the external air inlet wall has a plurality of external air inlets and has reinforcement elements on an inner side.

6. Suction cleaning apparatus in accordance with claim 5, wherein the reinforcement elements are configured as reinforcement ribs integrally formed on the external air inlet wall.

7. Suction cleaning apparatus in accordance with claim 1, wherein the external air inlet wall lies opposite a clean side of the at least one filter.

8. Suction cleaning apparatus in accordance with claim 1, wherein the at least one filter is configured as a flat pleated filter.

9. Suction cleaning apparatus in accordance with claim 8, wherein the external air inlet wall extends over an entire length of the flat pleated filter.

10. Suction cleaning apparatus in accordance with claim 1, wherein the closing body is manually movable.

11. Suction cleaning apparatus in accordance with claim 1, wherein the closing body is movable by means of a pivot lever.

12. Suction cleaning apparatus in accordance with claim 1, wherein the return spring contacts the outer side of the external air inlet wall.

13. Suction cleaning apparatus, comprising:

a dirt collection container which has a suction inlet and is fluidly connected to at least one suction unit via at least one filter and at least one suction channel, at least one external air inlet which opens out into the at least one suction channel downstream of the at least one filter and is selectively closable and openable by means of a closing body, the at least one suction channel having an external air inlet wall with at least one external air inlet, and the closing body, sliding along an outer side of the external air inlet wall, is reciprocatingly movable between a closed position closing the at least one external air inlet and an open position opening the at least one external air inlet, wherein the closing body, under action of a pressure difference between a negative pressure existing in the at least one suction channel during operation of the suction cleaning apparatus and an external pressure acting on an exterior of the closing body, is elastically deformable to a greater extent than the external air inlet wall.

14. Suction cleaning apparatus, comprising:

a dirt collection container which has a suction inlet and is fluidly connected to at least one suction unit via at least one filter and at least one suction channel, at least one external air inlet which opens out into the at least one suction channel downstream of the at least one filter and is selectively closable and openable by means of a closing body, the at least one suction channel having an external air inlet wall with at least one external air inlet, and the closing body, sliding along an outer side of the external air inlet wall, is reciprocatingly movable between a closed position closing the at least one external air inlet and an open position opening the at least one external air inlet, wherein the external air inlet wall has a plurality of external air inlets and has reinforcement elements on an inner side.

15. Suction cleaning apparatus in accordance with claim 14, wherein the reinforcement elements are configured as reinforcement ribs integrally formed on the external air inlet wall.

16. Suction cleaning apparatus, comprising:

a dirt collection container which has a suction inlet and is fluidly connected to at least one suction unit via at least one filter and at least one suction channel, at least one external air inlet which opens out into the at least one suction channel downstream of the at least one filter and is selectively closable and openable by means of a closing body, the at least one suction channel having an external air inlet wall with at least one external air inlet, and the closing body, sliding along an outer side of the external air inlet wall, is reciprocatingly movable between a closed position closing the at least one external air inlet and an open position opening the at least one external air inlet, wherein the closing body is manually movable.

17. Suction cleaning apparatus, comprising:

a dirt collection container which has a suction inlet and is fluidly connected to at least one suction unit via at least one filter and at least one suction channel, at least one external air inlet which opens out into the at least one suction channel downstream of the at least one filter and is selectively closable and openable by means of a closing body, the at least one suction channel having an external air inlet wall with at least one external air inlet, and the closing body, sliding along an outer side of the external air inlet wall, is reciprocatingly movable between a closed position closing the at least one external air inlet and an open position opening the at least one external air inlet, wherein the closing body is movable by means of a pivot lever.

* * * * *